US011944227B1

(12) United States Patent
Green et al.

(10) Patent No.: US 11,944,227 B1
(45) Date of Patent: Apr. 2, 2024

(54) CURTAIN LOWERING APPARATUS AND METHOD

(71) Applicants: Aiden Green, Netanya (IL); Thor Green, Netanya (IL)

(72) Inventors: Aiden Green, Netanya (IL); Thor Green, Netanya (IL)

( * ) Notice: Subject to any disclaimer, the term of this patent is extended or adjusted under 35 U.S.C. 154(b) by 0 days.

(21) Appl. No.: 18/153,377

(22) Filed: Jan. 12, 2023

(51) Int. Cl.
*A47H 7/02* (2006.01)
*A47H 5/14* (2006.01)

(52) U.S. Cl.
CPC ..... *A47H 7/02* (2013.01); *A47H 5/14* (2013.01)

(58) Field of Classification Search
CPC ... A47H 5/14; A47H 7/00; A47H 1/18; A47H 1/19; A47H 1/00; A47H 23/00; A63J 1/02; A63J 1/028
See application file for complete search history.

(56) References Cited

U.S. PATENT DOCUMENTS

| | | | | |
|---|---|---|---|---|
| 604,656 | A * | 5/1898 | Fischer | A47B 96/061 242/384.7 |
| 2,476,887 | A * | 7/1949 | Minarcik, Jr. | A47H 7/02 211/124 |
| 8,002,243 | B2 * | 8/2011 | Murphy | B66D 1/36 472/78 |
| 10,973,356 | B2 * | 4/2021 | Choi | A47H 1/142 |

FOREIGN PATENT DOCUMENTS

| | | | | |
|---|---|---|---|---|
| CN | 104367152 | A * | 2/2015 | A47H 3/10 |
| CN | 106724707 | A * | 5/2017 | |
| CN | 106724709 | A * | 5/2017 | A47H 1/02 |
| CN | 107669080 | A * | 2/2018 | |
| CN | 108742089 | A * | 11/2018 | A47H 5/0325 |
| DE | 29714918 | U1 * | 10/1997 | A47H 7/02 |
| DE | 4423490 | C2 * | 3/2001 | A47H 7/02 |
| DE | 20018408 | U1 * | 3/2001 | A47H 7/02 |
| EP | 1774999 | A1 * | 4/2007 | A63J 1/028 |
| WO | WO-2004098267 | A1 * | 11/2004 | A01G 9/227 |

OTHER PUBLICATIONS

Translation of CN106724709 (Year: 2017).*

(Continued)

*Primary Examiner* — Daniel P Cahn
*Assistant Examiner* — Jeremy C Ramsey
(74) *Attorney, Agent, or Firm* — Haim M. Factor—1st-Tech-Ideas.com

(57) ABSTRACT

A curtain lowering apparatus directed to cleaning and maintaining a curtain suspended above a floor, the apparatus having a first, not-lowered position at a height "H" above the floor, and a second, lowered position of H–L above the floor, the apparatus comprising: a curtain rod attached to at least two curtain rod rings, the curtain suspended from the curtain rod; at least two apparatus rod supports, the rod supports directed to support the at least two curtain rod rings; a drive unit configured to drive at least two drive cables, with respective drive cables routed through respective apparatus rod supports and respective drive cables further connected to respective curtain rod rings; wherein the curtain rod is alternately maintained at the first, not-lowered position and at the second, lowered position.

15 Claims, 8 Drawing Sheets

(56) References Cited

OTHER PUBLICATIONS

Translation of CN104367152 (Year: 2015).*
Translation of DE20018408 (Year: 2001).*
Translation of CN106724707 (Year: 2017).*
Translation of DE29714918 (Year: 1997).*
Machine translation CN108742089 (Year: 2018).*
Machine translation CN107669080 (Year: 2018).*
Ben Yakas, " Gothamist" on Oct. 1, 2011, entitled "Teen Fatally falls from Apartment Window in Curtain Hanging Accident", https://gothamist.com/news/teen-fatally-falls-from-apartment-window-in-curtain-hanging-accident.
Industrial Safety & Hygiene News (ISHN) on Jul. 6, 2017, https://www.ishn.com/articles/106830-000-falls-from- ladders-annually-97-percent-occur-at-home-or-on-farms.
US Bureau of Labor Statistics, The Economics Daily, Apr. 25, 2022 " Fatal injuries from ladders down in 2020; nonfatal adder injuries were essentially unchanged" https://www.bls.gov/opub/ted/2022/fatal-injuries-from-ladders-down- n-2020-nonfatal-ladder-injuries-were-essentially-unchanged.htm.
Peter Simeonov, Mar. 13, 2017 in the Centers for Disease Control and Prevention (CDC) https://blogs.cdc.gov/ hiosh-science-blog/2017/03/13/ladder-safety-month/.

* cited by examiner

View A - A

CURTAIN LOWERING APPARATUS AND METHOD

FIELD OF INVENTION AND BACKGROUND

Embodiments of the current invention relate to curtains and draperies and their maintenance and specifically to a curtain lowering apparatus and method directed to cleaning and maintaining curtains.

In the specification and claims which follow, the terms "curtain" "drapes", and "draperies" are used interchangeably and having the same meaning to refer to any decorative window and/or wall covering, usually made from a wide variety of fabrics, as known in the art.

Curtains are used widely in private homes as well as in public and business settings such as, but not limited to: hotels; convention centers; offices; stages; and schools. Reference is currently made to FIG. 1, which is a pictorial representation of an exemplary prior art curtain 3, positioned before and covering a window 4. Window 4 is shown in the current figure for illustration purposes, only. It should be understood that window 4, itself, is not an integral part of the curtain nor an integral part of embodiments of the current invention. Curtain 3 is suspended from curtain rod 5 which is held into position with two or more curtain rod supports 6, as known in the art. As shown in the current figure, curtain rod 5 is located above window 4, with the curtain rod located a distance "H" above a floor 7. Depending on where and in what application/location curtain 3 is suspended, distance H may typically vary from over about 2 m in most homes and up to 3-8 meters or more in some public locations.

Even in clean locations, curtain 3 must be removed and/or cleaned from time to time, as known in the art. A curtain cleaning process typically entails climbing a step stool or ladder a height equivalent to H above the floor to remove the curtain from the curtain rod for curtain laundering and/or dry cleaning and subsequently climbing again to height H above the floor to reattach the cleaned curtain onto the rod. In some settings, the curtain cleaning process may not entail removing the curtain from the curtain rod; however, in most cases additional equipment and/or climbing close to height H above the floor is necessary.

Clearly, such climbing, curtain removal and reattaching, and/or introduction of additional equipment make the curtain cleaning process not only difficult, but expensive and having associated risks, as described below.

In an article written by Ben Yakas, published in Gothamist on 1 Oct. 2011, entitled "Teen Fatally falls from Apartment Window in Curtain Hanging Accident", https://gothamist-.com/news/teen-fatally-falls-from-apartment-window-in-curtain-hanging-accident. Ben Yakas describes how Yohan Hernandez, a 14-year old Bronx boy slipped while hanging curtains in his 5th floor apartment and fell out the window to his death. Yohan Hernandez was standing on a chair installing curtains when the tragic accident occurred.

In an article published in Industrial Safety & Hygiene News (ISHN) on 6 Jul. 2017, https://www.ishn.com/articles/106830-000-falls-from-ladders-annually-97-percent-occur-at-home-or-on-farms, it is cited that according to the American Academy of Orthopedic Surgeons, every year 500,000 people are treated for ladder-related injuries and approximately 300 of these incidents prove to be fatal. In 2007 alone, more than 400 people died as a result of falls on or from ladders or scaffolding. Ladder-related injuries per 100,000 people rose almost 27 percent during a 16-year study period—97.3 percent occurred in non-occupational settings, such as homes and farms. More than 2.1 million people needed to be hospitalized, about twice the overall admission rate for consumer-product related injuries. The study concluded that given the 50 percent increase in ladder-related injuries during the study period, the relatively high likelihood of hospital admission, and the predominance of injuries in non-occupational settings, increased efforts are needed to prevent ladder-related injuries.

Citing information from the US Bureau of Labor Statistics, The Economics Daily, https://www.bls.gov/opub/ted/2022/fatal-injuries-from-ladders-down-in-2020-nonfatal-ladder-injuries-were-essentially-unchanged.htm, in an article from 25 Apr. 2022, entitled: "Fatal injuries from ladders down in 2020; nonfatal ladder injuries were essentially unchanged", it is noted that in 2020, there were 161 fatal work injuries from which ladders were the primary source. This was a 5.8-percent decline from 2019 (171 deaths). There were 105 deaths specifically from movable ladders in 2020 and 5 deaths from fixed ladders.

In an article by Peter Simeonov, published on 13 Mar. 2017 in the Centers for Disease Control and Prevention (CDC), https://blogs.cdc.goviniosh-science-blog/2017/03/13/ladder-safety-month/, Simeonov notes how each year in the U.S., more than 500,000 people are treated and about 300 people die from ladder-related injuries. The estimated annual cost of ladder injuries in the U.S. is $24 billion, including work loss, medical, legal, liability, and pain and suffering expenses. Data analysis from three surveillance systems in 2011 showed that workers who are male, Hispanic, older, self-employed, work in smaller establishments, and work in construction, maintenance, and repair experience higher rates of falls from ladders. It is evident from these numbers that ladder-related falls are a serious problem and that there is a need to reduce the resulting injury and death.

In addition to references hereinabove identifying substantial risks associated with climbing, readily-available internet and anecdotal information identify that the average cost to clean curtains is nearly $250, while "high end" work can cost up to $600.

There is therefore a need for an apparatus and method for lowering and subsequent raising of curtains, associated with their cleaning and maintenance, that is not only cost effective (meaning costing less than ordering periodic curtain cleaning) but that can significantly reduce and nearly eliminate risks associated with ladder and stepstool climbing to remove and reattach curtains.

SUMMARY OF THE INVENTION

According to one aspect of the present invention, there is provided a curtain lowering apparatus directed to cleaning and maintaining a curtain suspended above a floor, the apparatus having a first, not-lowered position at a height "H" above the floor, and a second, lowered position of H–L above the floor, the apparatus comprising: a curtain rod attached to at least two curtain rod rings, the curtain suspended from the curtain rod; at least two apparatus rod supports, the rod supports directed to support the at least two curtain rod rings; a drive unit configured to drive at least two drive cables, with respective drive cables routed through respective apparatus rod supports and respective drive cables further connected to respective curtain rod rings; wherein the curtain rod is alternately maintained at the first, not-lowered position and at the second, lowered position. Preferably, the drive unit includes: a first drive motor having a drive axle defining a drive axis, which has a first end and a second end, upon which drive axle elements are axially configured; and an electronics and communication unit, with the first drive motor, the drive axle, and the electronics and communications unit configured within an enclosure. Most preferably, the electronics and communications unit is connected to the first drive motor and the electronics and communications unit is configured to receive commands to lower and raise the curtain. Typically, the drive axle elements include: spacers located at the first end and at the second end; and an equal number of: bias springs; spools, drive discs; and friction pads; all of which are located between the spacers. Preferably, the enclosure has an opening through which the drive cables pass. Most preferably the drive unit is configured to maintain a level configuration of the curtain rod, substantially parallel to the floor, as the curtain rod is raised.

Typically, the drive unit is configured to raise and lower a total load representing the combined weight of: the curtain, the curtain rod; rod-curtain rings; and drive cables. Most typically, the equal number of: bias springs; spools, drive discs; and friction pads is 2 with a total load less than 14 kg and with two curtain rod rings. Preferably, the equal number of: bias springs; spools, drive discs; and friction pads is 3 with a total load ranging from 14 to 60 kg and with 3 curtain rod rings. Most preferably, an alternative configuration of the drive unit includes a second drive motor.

According to another aspect of the present invention, there is provided a method of operating a curtain lowering apparatus directed to cleaning and maintaining a curtain suspended above a floor, the apparatus having a first, not-lowered position at a height "H" above the floor, and a second, lowered position of H–L above the floor, the method comprising the steps of: suspending the curtain, which is attached to at least two curtain rod rings, from the curtain rod; configuring at least two apparatus rod supports to support the at least two curtain rod rings; configuring a drive unit to drive at least two drive cables, with respective drive cables routed through respective apparatus rod supports and the respective drive cables further connected to respective curtain rod rings; whereby the curtain rod is alternately maintained at the first, not-lowered position and at the second, lowered position. Preferably, the drive unit includes: a first drive motor having a drive axle defining a drive axis, which has a first end and a second end, upon which drive axle elements are axially configured; and an electronics and communication unit, with the first drive motor, the drive axle, and the electronics and communications unit configured within an enclosure. Most preferably, the electronics and communications unit is connected to the first drive motor and the electronics and communications unit is receives commands to lower and raise the curtain.

Typically, the drive axle elements include: spacers located at the first end and at the second end; and an equal number of: bias springs; spools, drive discs; and friction pads; all of which are located between the spacers. Most typically, the enclosure has an opening through which the drive cables pass, and the drive unit maintains a level configuration of the curtain rod, substantially parallel to the floor, as the curtain rod is raised. Preferably, the drive unit raises and lowers a total load representing the combined weight of: the curtain, the curtain rod; rod-curtain rings; and drive cables. Most preferably, the equal number of: bias springs; spools, drive discs; and friction pads is 2 when there is a total load less than 14 kg and with two curtain rod rings. Typically, the equal number of: bias springs; spools, drive discs; and friction pads is 3 with a total load ranging from 14 to 60 kg and with 3 curtain rod rings. Preferably, an alternative configuration of the drive unit includes a second drive motor.

LIST OF DRAWINGS

The invention is described herein, by way of example only, with reference to the accompanying drawings, wherein.

DETAILED DESCRIPTION

Embodiments of the current invention relate to curtains and draperies and their maintenance, and specifically to a curtain lowering apparatus and method directed to cleaning and maintaining curtains.

Figure 1:
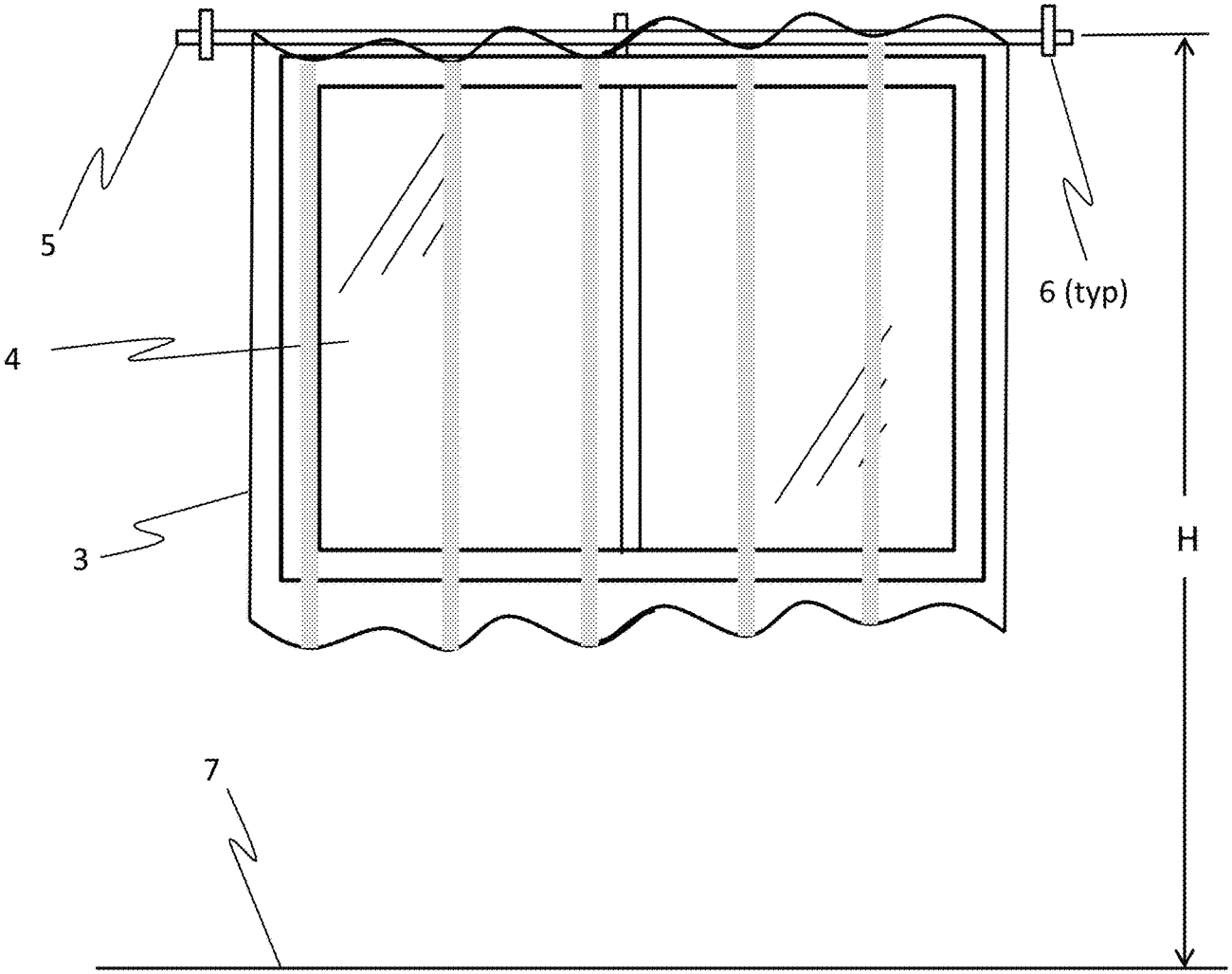
FIG 1 Prior Art
FIG. 1 is a pictorial representation of an exemplary prior art curtain, positioned before and covering a window.
Figure 2:
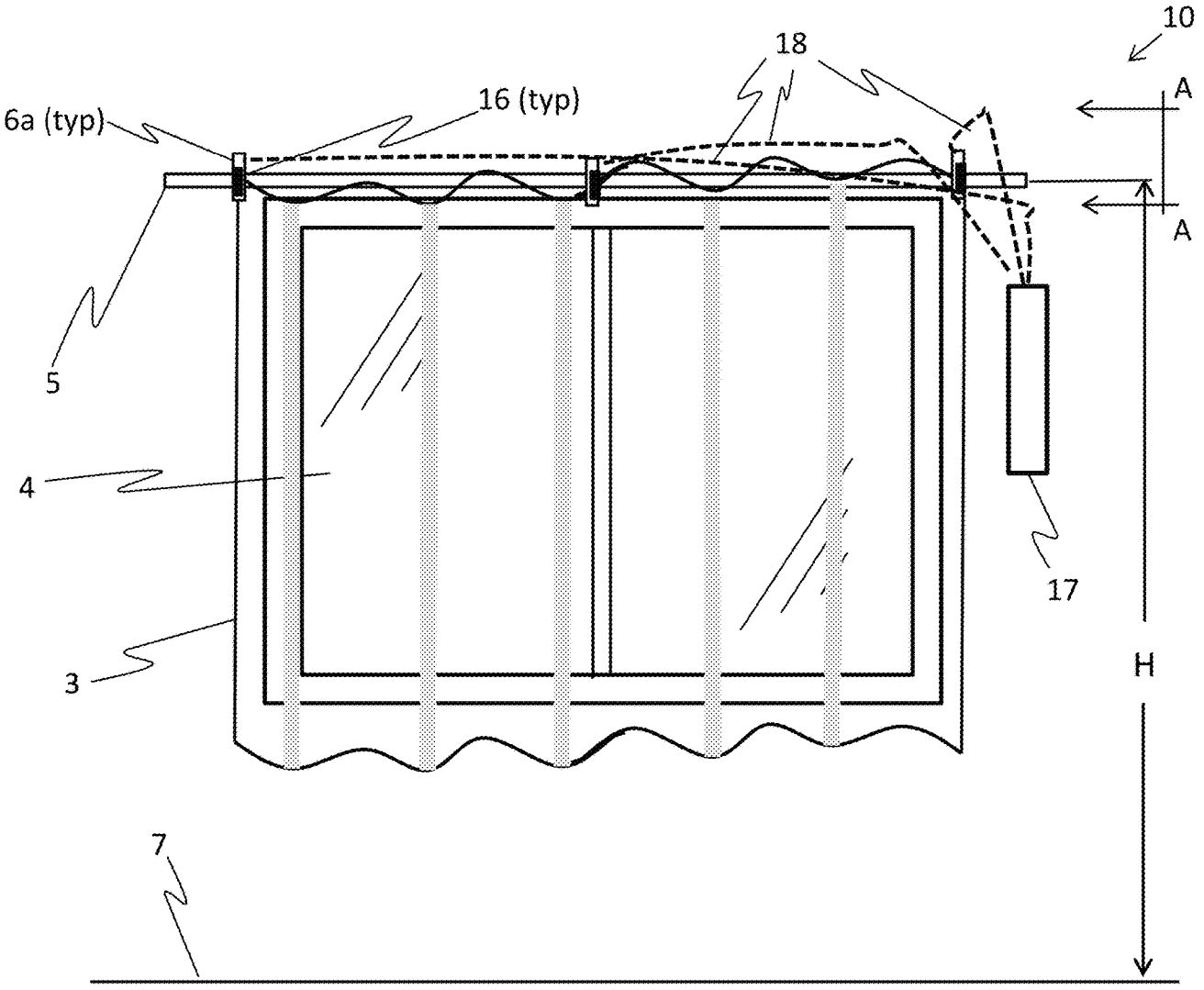
FIGS. 2 and 3 are pictorial representations of the exemplary prior art curtain of FIG. 1, having a curtain lowering apparatus in a first, not-lowered position (FIG. 2) and in a second, lowered position (FIG. 3), in accordance with embodiments of the current invention.
Figure 3:
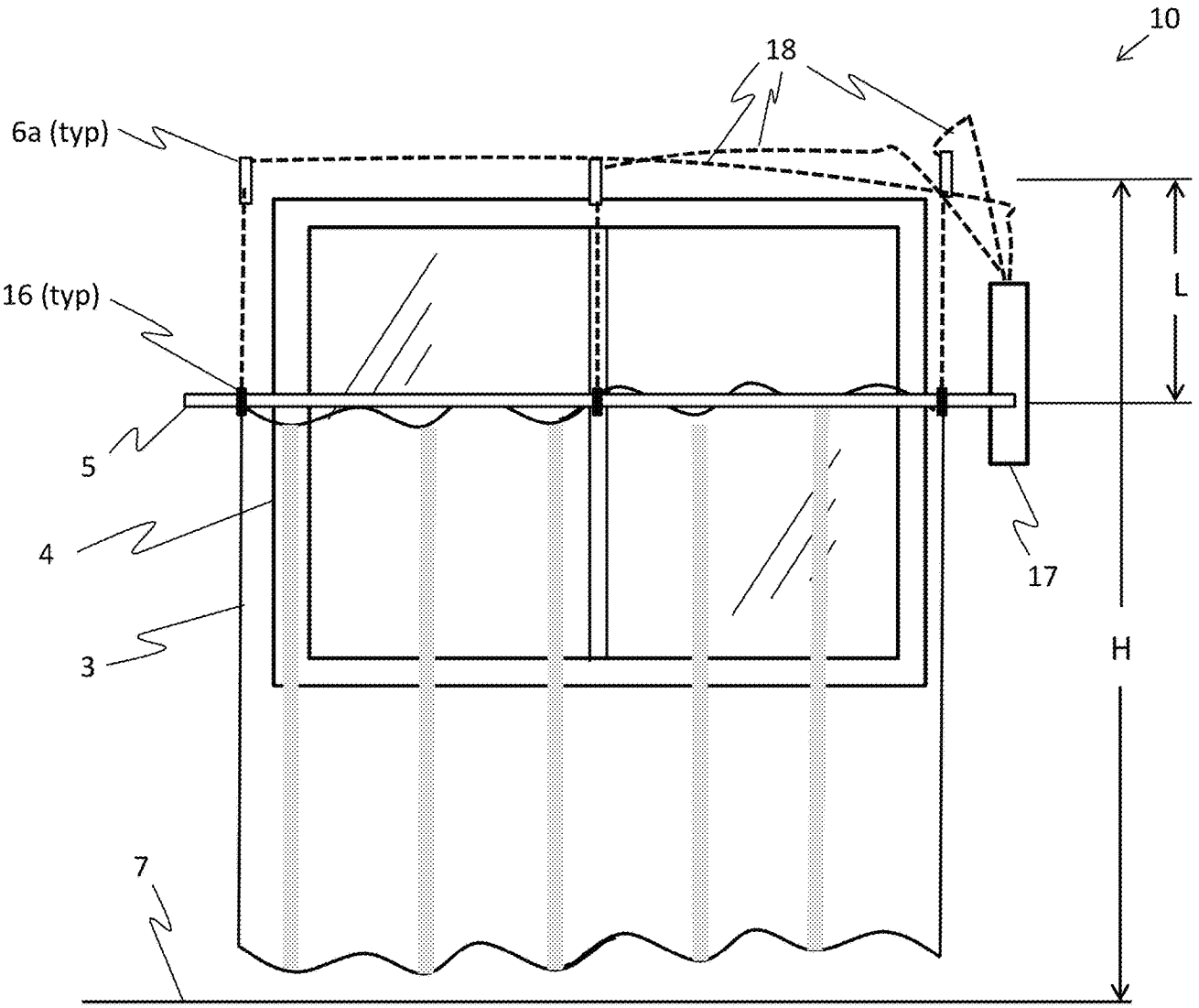

Reference is currently made to FIGS. 2 and 3, which are pictorial representations of the exemplary prior art curtain 3 of FIG. 1, having a curtain lowering apparatus 10 in a first, not-lowered position (FIG. 2) and in a second, lowered position (FIG. 3), in accordance with embodiments of the current invention. Apart from the differences described below, curtain 3, curtain rod 5, floor 7, and height H are identical in notation, configuration, and functionality to that shown in FIG. 1 and elements indicated by the same reference numerals and/or letters are generally identical in configuration, operation, and functionality as described hereinabove. In FIG. 3, the curtain rod is located a height "H"–"L" above floor 7, with "L" representing the distance the rod is lowered.

Curtain lowering apparatus includes: apparatus rod supports 6*a*; curtain rod rings 16; a drive unit 17; and drive cables 18. As can be seen schematically by comparing FIGS. 2 and 3, curtain lowering apparatus 10 serves to lower the curtain from the first position to the second position by distance L (or to raise the curtain from the second position to the first position). Lowering and raising the curtain is achieved by drive unit 17 driving drive cables 18 which run through apparatus rod supports 6*a*, and which connect to curtain rod rings 16, through which curtain rod 5 passes—all as seen in the figures and as further described hereinbelow. Although drive cables 18 are schematically shown in FIGS. 2 and 3 as having an arcuate routing, it is to be understood that the drive cables typically have a taut configuration (i.e., bearing a load, as described hereinbelow) and that the cables are further supported and/or drive unit is mounted in an alternate position to enable the taut configuration.

Drive unit 17 is commanded by a remote-control unit or optionally as a wired control unit, as known in the art, not shown in the figures. Optionally or additionally, drive unit 17 is commanded by voice commands, such as, but not limited to: Amazaon Alexa and Apple Siri—as known in the art.

Additionally shown in FIG. 2 is an indication of side-sectional view A-A, which is referred to hereinbelow in FIG. 7.

Figure 3A:
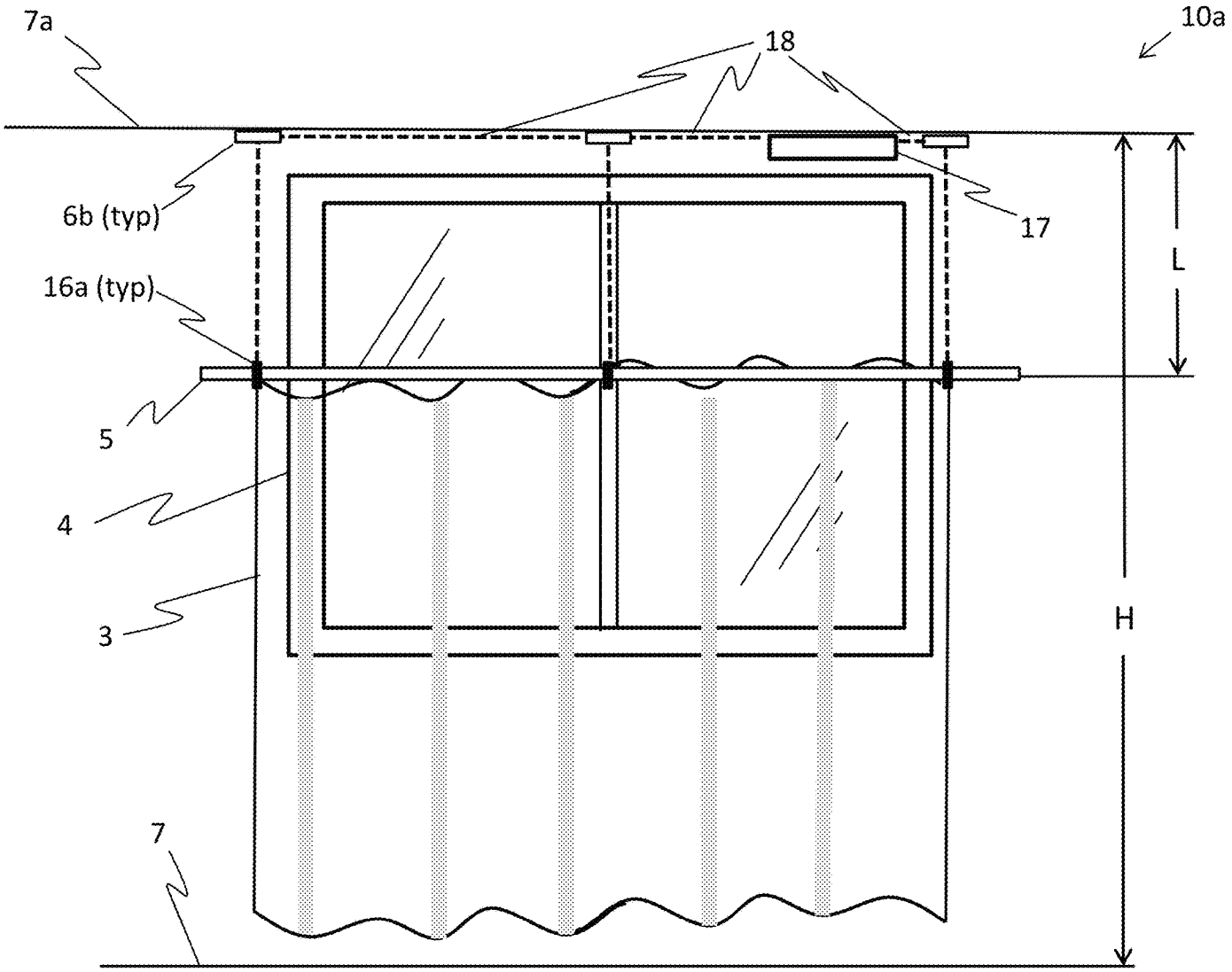
FIG. 3A is a pictorial representation of an alternate curtain lowering apparatus, in accordance with embodiments of the current invention.

Reference is currently made to FIG. 3A, which is a pictorial representation of an alternate curtain lowering apparatus 10*a*, in accordance with embodiments of the current invention. Alternate curtain lower apparatus 10*a* is mounted directly from a ceiling 7*a*. Apart from the differences described below, curtain 3, curtain rod 5, floor 7, and heights L and H are identical in notation, configuration, and functionality to that shown in FIG. 3 and elements indicated by the same reference numerals and/or letters are generally identical in configuration, operation, and functionality as described hereinabove.

Alternate curtain lowering apparatus 10*a* includes: apparatus rod supports 6*b*; curtain rod clips 16*a*; drive unit 17; and drive cables 18. Similar to curtain lowering apparatus 10 as shown in FIGS. 2 and 3, alternate curtain lowering apparatus 10*a* serves to lower the curtain from the first position to the second position by distance L (or, alternatively, to raise the curtain from the second position to the first position). Lowering and raising the curtain is achieved by drive unit 17 driving drive cables 18 which run through apparatus rod supports 6*b*, and which connect to curtain rod clips 16*a*, through which curtain rod 5 passes. In the current figure/configuration, curtain rod 5 may have a rectangular/rail cross-section configuration, as known in the art, allowing the curtain rod to be raised in close proximity to the ceiling and to apparatus rod supports 6*b*. Additionally, apparatus rod supports 6*b* are mounted directly to the ceiling, as shown in FIG. 3A, as opposed to apparatus rod supports 6*a*, as shown in FIGS. 2 and 3. Drive unit 17 mounted onto the ceiling and is likewise commanded by a remote-control unit or optionally as a wired control unit, as known in the art, not shown in the figures.

Elements of alternate curtain lowering apparatus 10*a* and curtain lowering apparatus 10 may be used interchangeably, with regard to ceiling mounting and/or routing of the drive cables and/or location of the drive unit, mutatis mutandis. Similarly, references hereinbelow and in the claims which follow to apparatus rod supports 6*a* and to curtain rod ring 16 are to be understood to be interchangeable with and to apply equally to apparatus rod supports 6*b* and to curtain rod clips 16*a*, mutatis mutandis.

Figure 4:
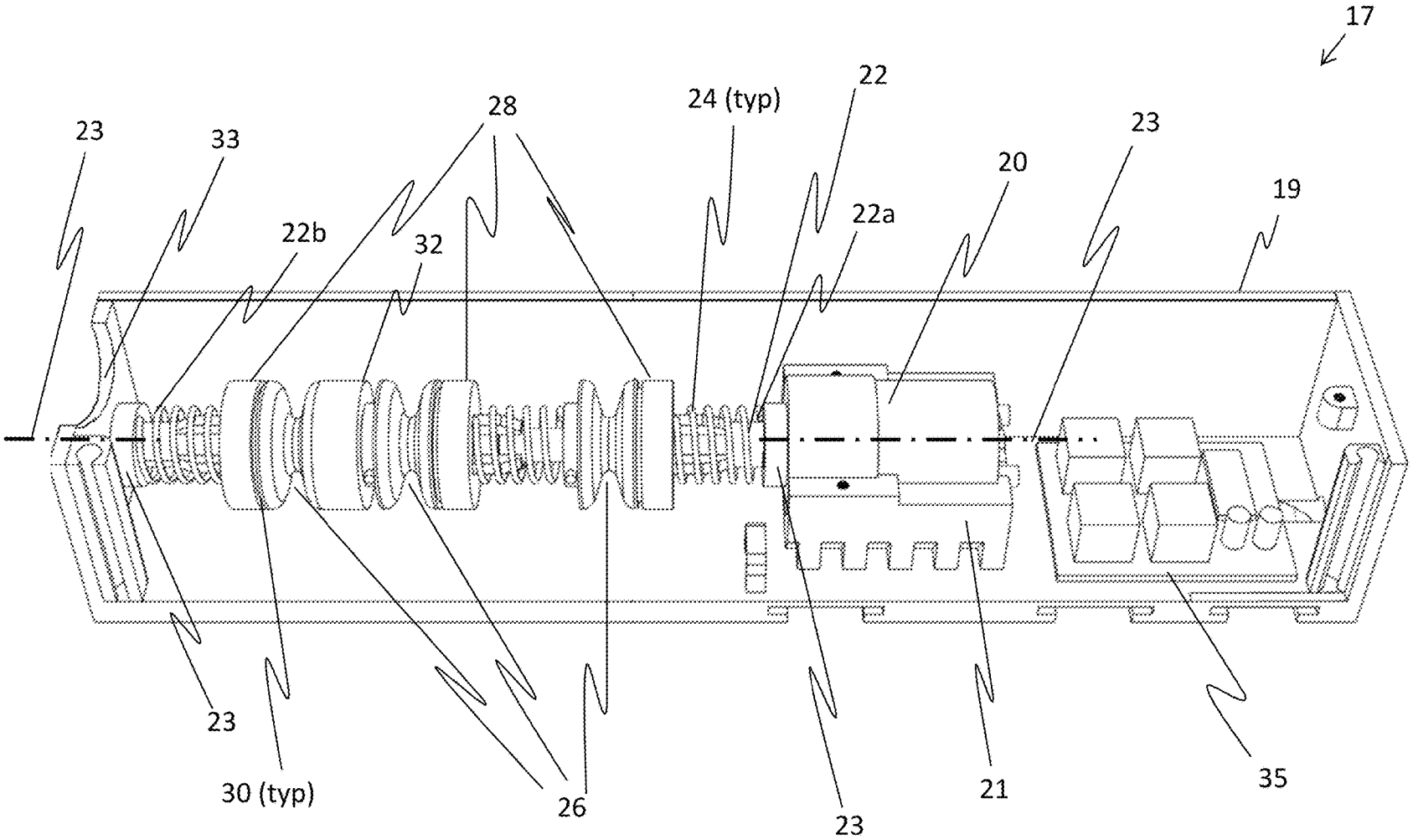
FIG. 4 is a detailed view of the drive unit, in accordance with embodiments of the current invention.

Reference is currently made to FIG. 4, which is a detailed view of drive unit 17, in accordance with embodiments of the current invention. Drive unit 17 has an enclosure 19 having a cover (not shown in the figure). The drive unit is shown in the current figure without the cover and without the drive cables (ref FIGS. 2 and 3)—all for purposes of clarity. Drive unit 17 includes: a first drive motor 20, which is mechanically mounted onto a drive motor support 21 (which is mechanically connected to enclosure 19), and a drive axle 22 having a first end 22*a* and a second end 22*b*. Drive axle 22 defines a drive axis 23 and all drive axle elements shown to the left of drive motor 21 in the current FIG. are axially configured upon drive axis 23. Drive unit 17 further includes: spacers 23; located at first end 22*a* and second end 22*b* of drive axle 22; bias springs 24; spools 26; drive discs 28; respective friction pads 30; and an opening 33 in enclosure 19. Opening 33 is configured to allow passage of drive cables 18 (ref FIGS. 2 and 3). In the current figure there are three each of bias springs 24, spools 26, drive discs 28, and friction pads 30, as discussed further hereinbelow.

Drive unit 17 further includes an electronics and communications unit 35, which is mounted within enclosure 19 and is electrically-connected to drive motor 23. The electronics and communications unit receives power from a mains source (not shown in the current figure) or optionally from an on-board power source, such as, but not limited to batteries. Electronics and communications unit 35 serves to receive remote or optional wired commands to lower and raise the curtain by activating the drive motor to rotate drive axle 22 and thereby to alternately spool/collect the drive cables onto spools 26 within the enclosure (thereby raising the curtain) or to unspool/release the drive cables from spools 26 and from the enclosure (thereby lowering the curtain). Bias springs 24, spools 26, drive discs 28, and respective friction pads 30 are configured on the drive axle to spool or unspool the drive cables in a clutch-like configuration, as known in the art.

One important aspect of drive unit 17 is that it serves to maintain a level configuration (i.e., a configuration substantially parallel to the floor) of curtain rod 5, as the curtain rod is raised, by collecting/spooling and maintaining a substantially uniformly taut configuration of the drive cables. Maintaining the uniformly taut configuration is accomplished by taking advantage of the clutch-like configuration described hereinabove of the bias springs, the spools, the drive discs, and the respective friction pads when the drive cables are collected/spooled, as further described hereinbelow. When all of curtain rod rings 16 are raised and contact respective apparatus rod supports 6*a* at substantially the same instant, then the level configuration (corresponding to the uniformly taut configuration of the drive cables) is maintained, and the respective drive cables are no longer spooled.

However, whenever at least one drive cable 18 is collected, and respective curtain rod ring 16 is resultantly raised—but the respective curtain rod ring does not contact its respective apparatus rod support 6*a*—then spooling of the respective drive cable continues, until curtain rod ring 16 contacts its respective apparatus rod support 6*a*. When curtain rod ring 16 contacts its respective apparatus rod support 6*a*, a tension of the respective drive cable momentarily increases, thereby providing a force stronger than that of the respective bias spring 24. When the stronger force acts upon respective bias spring 24, the respective bias spring disengages the respective friction pad from the respective drive disc—thereby yielding affecting the clutch-like configuration noted hereinabove.

The configuration of drive unit 17 shown in FIG. 4, with first drive motor 20, and three sets of bias springs 24, spools 26, drive discs 28, and friction pads 30, is suitable to raise and lower a total load of up to approximately 14 kg. In the specification which and claims, which follow hereinbelow, the expression "total load" is intended to mean the combined weight of: curtain 3, curtain rod 5, rod-curtain rings 16, and drive cables 18, as shown in FIGS. 2, 3, and 3A.

Drive unit 17 may be configured modularly with regard to the total load, as described hereinbelow. An optional or alternative exemplary configuration of drive unit 17 includes first drive motor 20, and two sets of bias springs 24, spools 26, drive discs 28, and friction pads 30—to raise and lower a total load under 14 kg with a curtain configuration having two curtain rod rings 16. An additional optional or alternative exemplary configuration of drive unit 17 includes first drive motor 20 and a second drive motor (not shown in the figure), and two or more sets of bias springs 24, spools 26, drive discs 28, and friction pads 30—to raise and lower a total load ranging from 14 to 60 kg for a curtain configuration having two or more curtain rod rings 16.

Figure 5:
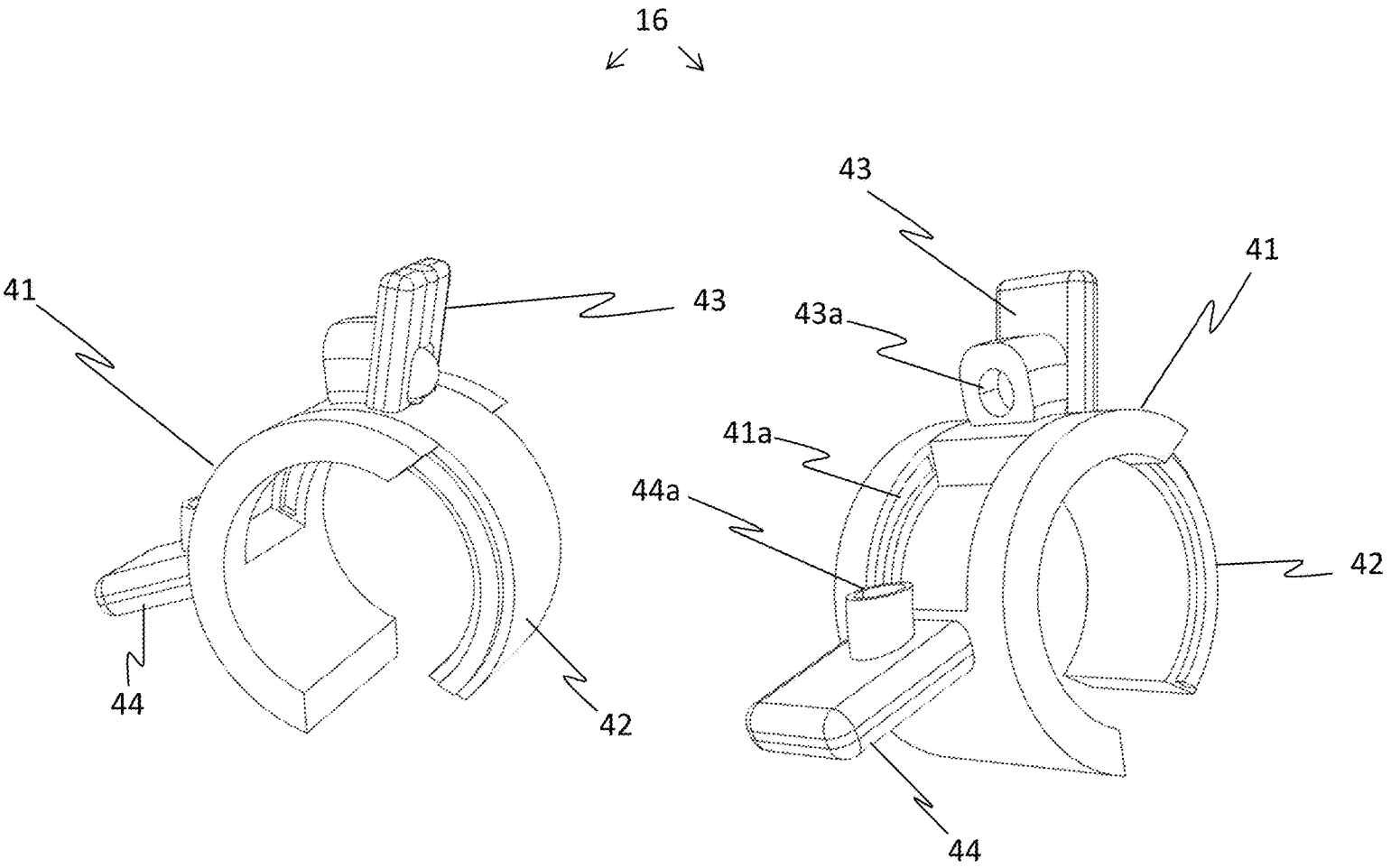
FIG. 5 shows two isometric representations of one of rod-curtain rings, in accordance with embodiments of the current invention.

Reference is currently made to FIG. 5, which shows two isometric representations of one of curtain rod rings 16, in accordance with embodiments of the current invention. One of curtain rod rings 16 includes: a first housing ring 41 having a generally circular shape; a second housing 42 configured to fit and to slide in an arcuate track 41*a* within first housing 41; a second housing extension 43 having an optional spring retention hole 43*a* therein; and a first housing extension 44 having an optional spring retention hole 44*a* therein.

Curtain rod ring 16 has a normally-closed configuration (as shown in the figures) when it is in position, serving to retain the curtain rod (as shown in FIGS. 2 and 3 hereinabove), with the curtain rod ring being biased to the normally-closed configuration by bias springs (not shown in the figure). Coil springs, as known in the art, may be configured within arcuate track 41 or coil or leaf springs may be configured between two spring retention holes 43*a* and 44*a* to serve as the bias springs. Opening curtain rod ring 16 to an open configuration (such as when installing the curtain rod ring onto the curtain rod or when removing the curtain rod ring from the curtain rod) is accomplished by grasping and pressing the two housing extensions towards one another to displace second housing 42 within arcuate track 41 and thereby open the curtain rod ring.

Figure 6B:
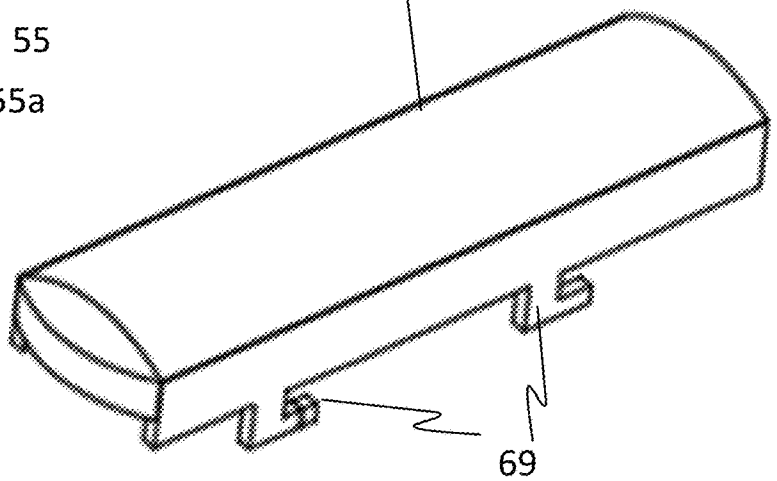
FIGS. 6A and 6B are, respectively, a detailed isometric view of one of apparatus rod supports and an apparatus rod support cover, in accordance with embodiments of the current invention.
Figure 6A:
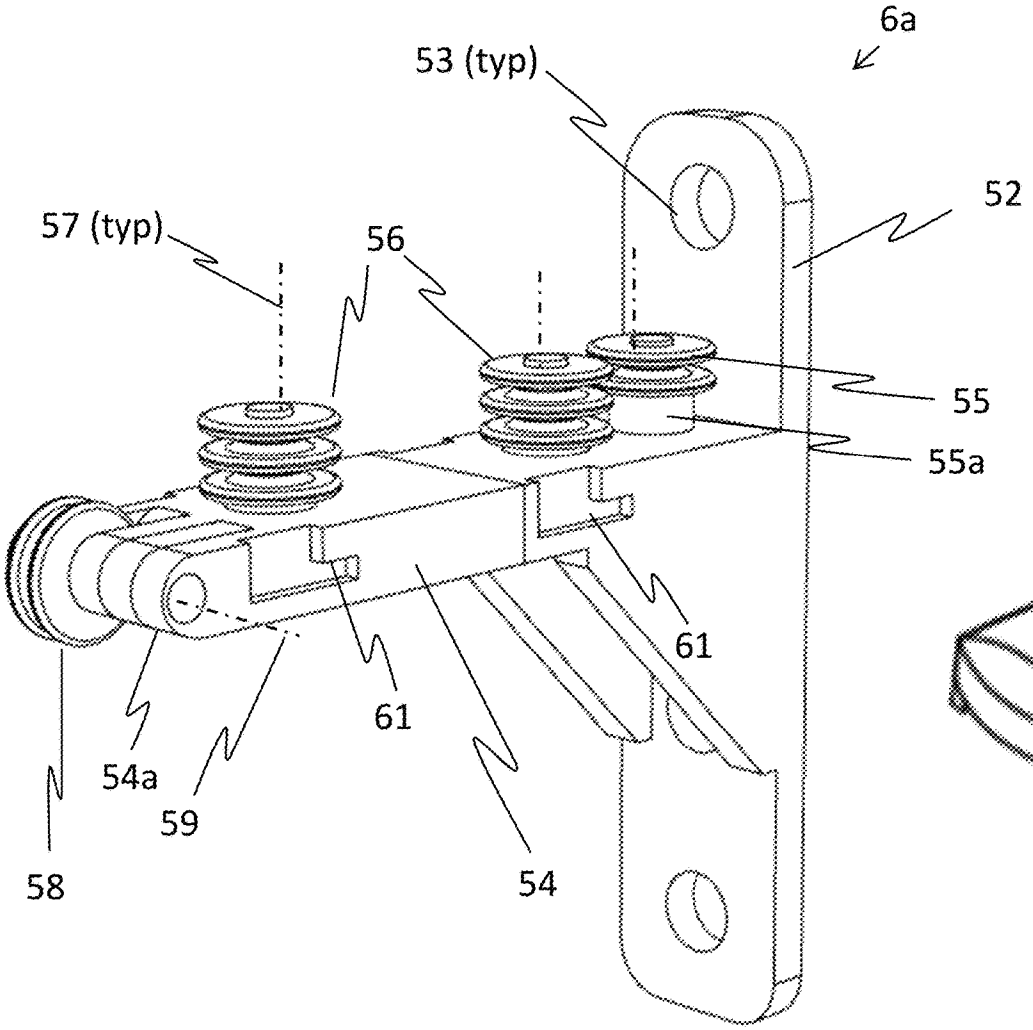

Reference is currently made to FIGS. 6A and 6B, which are, respectively, a detailed isometric view of one of apparatus rod supports 6*a* and of an apparatus rod support cover 65, in accordance with embodiments of the current invention. Apart from the differences described below, apparatus rod supports 6*a* are identical in notation, configuration, and functionality to that shown in FIGS. 2 and 3 hereinabove.

Referring to FIG. 6A, one of apparatus rod supports 6*a* includes a support bracket 52, which is mounted to a wall (not shown in the figures) and which has at least two wall-mounting holes 53 therein and a bracket arm 54, with bracket arm 54 extending substantially perpendicularly from the wall, as known in the art, and terminating at a bracket arm end 54*a*. Configured upon bracket arm 54 are: a first wire spool 55, mounted upon a first wire spool spacer 55*a*, and two wire spools pairs 56, with each of the two wire spool pairs having a double-spool configuration and with the two wire spool pairs and the first wire spool mounted coaxially upon respective wire spool axes 57 extending vertically and perpendicularly from bracket arm 54—as shown in FIG. 6A.

An alternate configuration of one of apparatus rod supports 6*a* (not shown in the current figures) includes only one wire spool pair 56, with the wire spool pair having a double-spool configuration and with the wire spool pair and the first wire spool mounted coaxially upon respective wire spool axes 57 as described hereinabove.

Additionally configured upon the bracket arm are a last wire spool 58, mounted at bracket arm end 54*a* and coaxially with last wire spool axis 59, the last wire spool axis being oriented substantially perpendicularly to bracket arm 54 and perpendicularly to wire spool axes 57. Last wire spool 58, two wire spool pairs 56, and first wire spool 55 are respectively oriented to guide the drive cables (not shown in the figure—but as shown in FIGS. 2 and 3 and as further discussed hereinbelow). At least two slot-depressions 61 are formed in bracket arm 54 to receive and retain apparatus rod support cover 65. At least 2 extensions 69 to rod support cover 65 serve to engage in the at least two slot depressions to retain the rod support cover.

Figure 7:
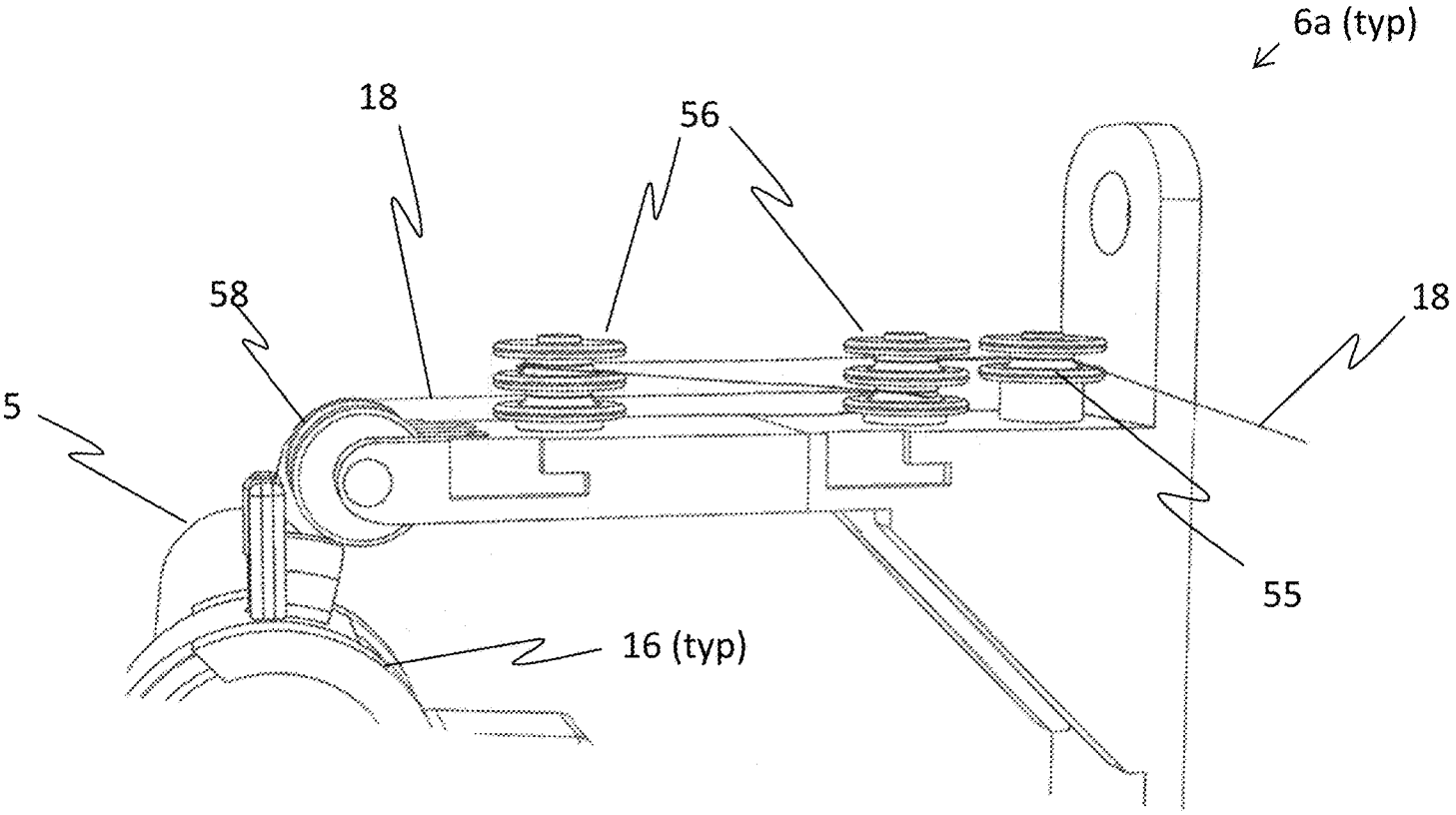
FIG. 7 is a detailed side sectional view A-A of FIG. 2, showing details of one of apparatus rod supports and one of drive cables, in accordance with embodiments of the current invention.

Reference is currently made to FIG. 7, which is a detailed side sectional view A-A of FIG. 2, showing details of one of apparatus rod supports 6*a* and one of drive cables 18, in accordance with embodiments of the current invention. Apart from the differences described below, apparatus rod support 6*a* is identical in notation, configuration, and functionality to that shown in FIGS. 2, 3, and 6A hereinabove and curtain rod ring 16 is identical in notation, configuration, and functionality to that shown in FIGS. 2, 3, and 5 hereinabove. In the current figure, drive cable 18 is shown having a typical wiring configuration, initiating from drive unit 17 (shown in FIG. 4), spooled once around first wire spool 55, then around two wire spool pairs 56, and then over last wire spool 58 and connected to curtain rod 16. The typical wiring configuration of the drive cable enables smooth and efficient raising and lowering of the curtain, as described hereinabove regarding FIGS. 2, 3, and 4.

It will be appreciated that the above descriptions are intended only to serve as examples, and that many other embodiments are possible within the scope of the present invention and as defined in the appended claims.

The invention claimed is:

1. A curtain lowering apparatus directed to cleaning and maintaining a curtain suspended above a floor and near a wall, the apparatus having a first, not-lowered position above the floor, and a second, lowered position above the floor, the apparatus comprising:

a curtain rod attached to at least two curtain rod rings; the curtain suspended from the curtain rod;

at least two apparatus rod supports, each apparatus rod support having a support bracket mounted to the wall and a bracket arm extending substantially perpendicularly from the wall, the at least two rod supports directed to support the at least two curtain rod rings and to displace the curtain from the wall;

a drive unit configured to drive at least two drive cables, with respective ones of the drive cables routed through respective ones of the apparatus rod supports and the respective ones of the drive cables further connected to the respective ones of the curtain rod rings;

wherein the drive unit includes: a first drive motor having a drive axle having a drive axis extending longitudinally through the drive motor and aligned coaxially with the drive axe, the drive axle having a first end and a second end, upon which drive axe elements are axially configured; and an electronics and communication unit, with the first drive motor, the drive axle, and the electronics and communications unit configured within an enclosure and the at least two apparatus rod supports are not configured within the enclosure and the at least two apparatus rod supports and the first drive motor are not directly connected;

wherein the drive axle elements include: spacers located at the first end and at the second end, and an equal number of bias springs, spools, drive discs, and friction pads, all of which are located between the spacers;

wherein the curtain rod is alternately maintained at the first, not-lowered position and at the second, lowered position.

2. The apparatus according to claim 1, wherein the electronics and communications unit is connected to the first drive motor and the electronics and communications unit is configured to receive commands to lower and raise the curtain.

3. The apparatus according to claim 1, wherein the enclosure has an opening through which the drive cables pass.

4. The apparatus according to claim 3, wherein the drive unit is configured to maintain a level configuration of the curtain rod, substantially parallel to the floor, as the curtain rod is raised.

5. The apparatus according to claim 4, wherein the drive unit is configured to raise and lower a total load representing the combined weight of: the curtain, the curtain rod, the at least two rod-curtain rings, and the at least two drive cables.

6. The apparatus according to claim 5, wherein the equal number of bias springs, spools, drive discs, and friction pads is 2 with a total load less than 14 kg.

7. The apparatus according to claim 6, wherein the equal number of bias springs, spools, drive discs, and friction pads is 3 with a total load ranging from 14 to 60 kg.

8. The apparatus according to claim 7, wherein an alternative configuration of the drive unit includes a second drive motor, in addition to: the first drive motor, the drive axle elements, and the electronics and communication unit.

9. A method of operating a curtain lowering apparatus directed to cleaning and maintaining a curtain suspended above a floor and near a wall, the apparatus having a first, not-lowered position above the floor, and a second, lowered position above the floor, the method comprising the steps of:

suspending the curtain, which is attached to at least two curtain rod rings, from the curtain rod;

configuring at least two apparatus rod supports, each apparatus rod support having a support bracket mounted to the wall and a bracket arm extending substantially perpendicularly from the wall, the at least two rod supports directed to support the at least two curtain rod rings and to displace the curtain from the wall;

configuring a drive unit to drive at least two drive cables, with respective ones of the drive cables routed through respective ones of the apparatus rod supports and the respective ones of the drive cables further connected to the respective ones of the curtain rod rings;

wherein the drive unit includes: a first drive motor having a drive axle having a drive axis extending longitudinally through the drive motor and aligned coaxially with the drive axle, the drive axle having a first end and a second end, upon which drive axle elements are axially configured; and an electronics and communication unit, with the first drive motor, the drive axle, and the electronics and communications unit configured within an enclosure and the at least two apparatus rod supports are not configured within the enclosure and the at least two apparatus rod supports and the first drive motor are not directly connected;

wherein the drive axle elements include: spacers located at the first end and at the second end, and an equal number of bias springs, spools, drive discs, and friction pads, all of which are located between the spacers;

whereby the curtain rod is alternately maintained at the first, not-lowered position and at the second, lowered position.

10. The method according to claim 9, whereby the electronics and communications unit is connected to the first drive motor and the electronics and communications unit receives commands to lower and raise the curtain.

11. The method according to claim 9, whereby the enclosure has an opening through which the drive cables pass, and the drive unit maintains a level configuration of the curtain rod, substantially parallel to the floor, as the curtain rod is raised.

12. The method according to claim 11, whereby the drive unit raises and lowers a total load representing the combined weight of: the curtain, the curtain rod, the at least two rod-curtain rings, and the at least two drive cables.

13. The method according to claim 12, whereby the equal number of bias springs, spools, drive discs, and friction pads is 2 when there is a total load less than 14 kg.

14. The method according to claim 13, whereby the equal number of bias springs, spools, drive discs, and friction pads is 3 with a total load ranging from 14 to 60 kg.

15. The method according to claim 14, whereby an alternative configuration of the drive unit includes a second drive motor, in addition to the first drive motor, the drive axle elements, and the electronics and communication unit.

* * * * *